United States Patent [19]

Demangeon et al.

[11] Patent Number: 4,556,509

[45] Date of Patent: Dec. 3, 1985

[54] LIGHT DUTY DETERGENTS CONTAINING AN ORGANIC DIAMINE DIACID SALT

[75] Inventors: Yvon Demangeon, Hardicourt, France; Alain Jacques, Blegny, Belgium

[73] Assignee: Colgate-Palmolive Company, New York, N.Y.

[21] Appl. No.: 659,197

[22] Filed: Oct. 9, 1984

[51] Int. Cl.[4] ..... C11D 1/40; C11D 3/30

[52] U.S. Cl. ..... 252/542; 252/541; 252/544; 252/545; 252/548; 252/550; 252/551; 252/554; 252/558; 252/DIG. 14

[58] Field of Search ..... 252/541, 544, 545, 551, 252/, 550, 554, 558, DIG. 14, 548, 542

[56] References Cited

U.S. PATENT DOCUMENTS

| | | | |
|---|---|---|---|
| 3,003,970 | 10/1961 | Call | 252/544 |
| 3,173,876 | 3/1965 | Zobrist | 252/544 |
| 4,192,692 | 3/1980 | Herrmann | 134/2 |
| 4,321,167 | 3/1982 | Schmolka | 252/548 |
| 4,486,329 | 12/1984 | Ellis et al. | 252/117 |

FOREIGN PATENT DOCUMENTS 1147262 5/1983 Canada .

*Primary Examiner*—Prince E. Willis

*Attorney, Agent, or Firm*—Richard N. Miller; Murray M. Grill; Herbert S. Sylvester

[57] ABSTRACT

The improvement in a light duty detergent composition containing anionic sulfonated surfactants or mixtures of anionic sulfonate and nonionic surfactants is disclosed which comprises the inclusion therein of an effective amount of a low molecular weight organic diamine diacid salt selected from the range wherein the mole ratio of mono-anionic detergent to organic diamine diacid salt is from 0.8:1 to 9:1 and sufficient to improve soft water foaming and degreasing properties. These compositions are especially suitable for dishwashing.

11 Claims, No Drawings

LIGHT DUTY DETERGENTS CONTAINING AN ORGANIC DIAMINE DIACID SALT

BACKGROUND OF THE INVENTION

The present invention relates to light duty detergent compositions based on anionic sulfonate and/or sulfate surfactants, optionally containing nonionic surfactants, of enhanced foam stability and degreasing ability, particularly in water of less than about 70 ppm hardness, preferably 50 ppm or less and most preferably 0 pm, containing a low molecular weight organic diamine diacid salt.

Light duty detergent compositions in commercial use at the present time are usually in liquid form and are based on sodium and/or ammonium salts of anionic, sulfonated detergents with or without nonionic surfactants, which together with additives such as conventional foam boosters, provide satisfactory detergency and foaming as shown in U.S. Pat. No. 3,755,206. However, the major drawback of these detergent compositions is that their foaming and/or degreasing performance in water of hardness below about 70 ppm is very poor.

The prior art discloses the addition of magnesium and/or calcium salts to detergent compositions to improve washing performance, especially under soft water conditions, as shown by U.S. Pat. No. 2,908,651 wherein magnesium chloride or magnesium sulphate is incorporated in liquid detergent formulations containing an alkali metal or amine salt of an alkylaryl sulfonic acid and hydrotropes and by British Pat. No. 1,164,854 wherein a magnesium salt, e.g., magnesium sulfate, is added to a liquid detergent composition based on alkylbenzene sulphonate and a nonionic surfactant and/or an alkyl or alkylphenol-polyether sulfate.

The prior art discloses the use of magnesium salts of anionic surfactants as another means of obtaining improved foaming detergency performance in soft water as shown in British Pat. No. 948,383 wherein the liquid detergent compositions contain up to 30% of anionic sulfonated detergent and magnesium xylene or toluene sulfonate as solubilizer for improving the diswashing performance in soft water; French Pat. No. 1,233,047 wherein the detergent composition is based on up to 30% by weight of magnesium alkylaryl sulfonate added to a mixture of sodium or triethanolamine alkylsulfate and an alkylpolyether sulfate; Netherlands Pat. No. 7,607,160 wherein the liquid detergent composition is based on magnesium salts of a broad class of anionic sulfonated or sulfate detergents and a nonionic condensation product of ethylene oxide; and U.K. Pat. No. 2,010,893 wherein the liquid concentrated detergent composition is based on magnesium alkylbenzene sulfonate containing dialkyltetralin and an alkali metal, ammonium or amine alkyl polyether sulfate and/or a nonionic surfactant.

Also disclosed in the prior art is the use of polyamino compounds in detergent compositions as shown in U.S. Pat. No. 2,267,205 wherein N-alkylated polyamines such as N-n-$C_6$-$C_{10}$ alkyl ethylene diamine in the form of a free base is used as an alkaline surface active agent in lieu of sulfated higher alcohol salts and the use of ethylene diamine in aqueous cleaning compositions for metals and glass as shown in U.S. Pat. Nos. 3,003,970, 3,309,321, and 3,173,876. However, none of the aforesaid patents disclose anionic surfactant based liquid detergents containing the diacid salts of a low molecular weight organic diamine.

In U.S. Pat. No. 3,935,129, the problem of providing a composition capable of cleaning in water of any hardness is also acknowledged, and it provides for a composition useful as a shampoo or dishwashing composition comprising 55 parts anionic detergent, 20 parts nonionic detergent, 9 parts triethanolamine, 10 parts glycerine and 6 parts urea which is added to 250 parts by weight of water.

U.S. Pat. No. 4,001,123 discloses the use of urea or sugar treated N-higher alkyl-1,3-propylene diamines as fabric softening agents in compositions containing anionic detergents, nonionic detergents and alkaline builder salts which are heavy duty detergent compositions.

However, none of the above patents disclose a light duty detergent composition, based on anionic sulfonated surfactants or a mixture of such anionic and nonionic surfactants containing 1–10% by weight of a diacid salt of a low molecular weight aliphatic diamine having effective foamability and degreasing ability in both soft and hard water.

The Industrial and Engineering Chemistry article by Wilson, Vol. 27 (#8) 867–71 (1935) which discloses ethylene diamine dihydrochloride, the propylene diamine and piperazine eqivalents thereof, their synthesis and their reactions with acids to form diacid salts is included as part of this specification. However, there is no suggestion of the use of these diacid salts together with a detergent.

SUMMARY OF THE INVENTION

It has now been found that the addition of an effective amount of a diacid salt of a low molecular organic diamine to a light duty detergent composition comprising an anionic sulfonated surfactant as the active ingredient significantly improves the foam stability and cleaning efficiency of said detergent composition in deionized water and in soft water having a hardness of less than about 70 ppm where the mole ratio of said anionic sulfonated surfactant to said amine is in the range of 0.8: to 9:1, preferably 1:1 to 6:1. This discovery is particularly useful in light duty, liquid compositions because the clarity and stability of such liquid composition is not adversely affected.

Accordingly, the primary object of the invention is to provide novel anionic sulfonate surfactant based light duty detergent compositions containing an effective amount of a diacid salt of a low molecular weight organic diamine for improving the foaming and degreasing properties in soft water.

Another object of this invention is to provide a novel light duty, liquid, detergent composition with effective foamability and degreasing ability in both soft and hard water.

Still another object of this invention is to provide an improvement in the foaming and degreasing ability of light duty, liquid, detergent compositions containing a reduced amount of the detergent active ingredients comprising anionic sulfonated surfactants and, optionally, nonionic surfactants in deionized water and in soft water having a hardness of less than 70 ppm.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects in accordance with the present invention, as embodied and broadly described herein, the novel light duty detergent (LDD) composition of this invention comprises 5% to 50% by weight of an anionic sulfonated surfactant based composition, optionally containing a nonionic surfactant, and an effective amount of a diacid salt of a low molecular weight organic diamine selected from the range wherein the mole ratio of mono-anionic sulfonated detergent to said amine salt is from 0.8:1 to 9:1, preferably 1:1 to 6:1, and being sufficient to improve the soft water foaming and degreasing performance.

More particularly, the present invention relates to the improvement in light duty, liquid, detergent compositions containing 10% to 40% by weight of anionic sulfate or sulfonate detergent solubilized in an aqueous medium comprising the inclusion therein of an effective amount of a diacid salt of a low molecular weight organic diamine, the mole ratio of said mono-anionic detergent to said amine salt being from 0.8:1 to 9:1 and being sufficient to improve soft water foaming and degreasing ability.

DETAILED DESCRIPTION OF THE INVENTION

The foaming and degreasing agent utilized in the present invention is a diacid salt of an organic diamine selected from the group consisting of piperazine, phenylene diamine, xylene diamine, $C_2$–$C_4$ alkylene diamines and condensates of $C_2$–$C_{11}$ alkylene diamines and 1 to 4 moles of ethylene oxide with the acid being selected from the group consisting of hydrochloric, nitric and sulfuric acid. The specific organic diamine diacid salts utilized in this invention include ethylene diamine dihydrochloride, propylene diamine dihydrochloride, the mono-, di-, tri- and tetra-ethoxylates of said alkylene diamine dihydrochlorides; the dihydrosulfuric acid salts and dinitric acid salts of the ethylene diamine, propylene diamine, piperazine and the ethoxylates thereof. The efficiency of the organic di-cations, N and N', decreases when hydrogen atoms of the amine are substituted by methyl, ethyl, propyl, etc. groups because the said alkyl groups are electron donors and reduce the net positive charge of the nitrogen atoms and also cause steric hindrance reducing the availability of the negative charge (anionic surfactants). Furthermore, a large R group, such as $C_6$ alkylene as in N,N' hexamethylene diamine dihydrochloride, may result in an unclear and unstable formulation. However, an anionic detergent formulation containing the N,N' hexamethylene diamine dihydrochloride exhibits some improvement in foaming ability using the Automatic Miniplates Test in 0 ppm water hardness—14 miniplates (MP) as compared to 44 miniplates with the ethylene diamine dihydrochloride additive. Another factor that affects the soft water foaming efficiency of the diamine diacid salts is the distance between the two nitrogen cations represented by the chain length therebetween, i.e., the number of ethylene groups. The larger the chain length, the more difficult it is to formulate a stable product. Also, the influence of the organic cations seems to disappear when the chain length between the nitrogen atoms exceeds 11 carbon atoms. The preferred diacid salts fo the organic diamines are the dihydrochlorides of piperazine, ethylene diamine and propylene diamine and the dihydrosulfates of ethylene diamine and propylene diamine.

This ability to improve the foaming and degreasing properties of anionic based LDD in soft water is specific to the organic diamine diacid salts. The alkylene triamine and tetramine acid salts are totally ineffective herein. Substituting the acid salt of diethylene triamine or of triethylene tetramine for the diamine salt in an anionic sulfonated based detergent results in no foaming (0 MP), whereas the ethylene diamine salt composition washes 25 MP.

A miniplates test is used to determine the total number of plates washed in the detergent until the foam is killed in order to demonstrate the improvement in cleaning efficiency as gauged by foam volume and foam stability. In the Automatic Miniplate Dishwashing Test, the foam is generated by agitating an appropriate detergent concentration in water, e.g., 1.25 g/l, using a system of 7 brushes actuated by a hypocycloidal motion. Approximately 400 ml. of detergent solution is maintained in a cylindrical vessel having a water jacket and the temperature of the solution is adjusted to 47° C. at the beginning of the test. Each of the seven brushes used for agitation has a diameter of 5 mm. and a length of 24 mm. The seven brushes are fitted on a support on three different levels, with the brushes on the first two levels being separated by a 120° angle. The brushes intersect the surface of the washing liquid at an angle of about 70° and said brushes are oscillated at a rate of 60 rounds per minute. The hardness of the water is controlled as desired and is expressed as ppm of calcium carbonate. A syringe continuously injects Crisco® soil(a commercially available shortening product) into the solution at a rate of 0.6 g/min. (Crisco® soil melts at 43° C., and is a triglyceride of the following fatty acid mixture: 0.2% myristic, 16.5% palmitic, 12% stearic, 52% oleic and 19% linoleic.) The reflectance of the surface is automatically and continuously monitored by two Model 8 PVI AAB Photo Voltaic Cells manufactured by General Electric Co. which are electrically connected to a Beckman recorder. The disappearance of foam is interpolated from the instrumental curve and the number of miniplates is calculated from the foam end point abscissa and the soil flow rate according to the following formula:

$$\text{Number of miniplates} = \frac{T \times F}{0.12}$$

T=Time in minutes between start of Crisco introduction and the time where no foam is noted F=Crisco flow rate in g/min.

The number of miniplates determined in this test corresponds to the number of soiled dinner plates washed by a skilled operator in a dishpan after controlled generation of foam on the surface of the washing solution. Thus, this test closely approximates the results noted by the user in actual use of a dishwashing product.

In each of the tested formulae, EDAC markedly improves the foam stability in water at 0 ppm hardness without significantly changing the performance in 300 ppm hard water.

The foregoing 25% and 40% active ingredient formulae containing 5% EDAC were evaluated in water at 0 ppm hardness and 300 ppm as shown in Table II, using the Baumgartner Degreasing Test. Such test comprises soiling cleaned glass slides (2.5 cm×0.1 cm) by dipping for ten seconds in a grease soil (a mixture of 5 parts of Keen Gold vegetable shortening, 2 parts by weight of beef tallow and 1 part by weight of glyceryl tristearate) maintained at a temperature of 54° C., cooling the soiled slides, aging the soiled slides at room temperature, i.e., 24° C., and 55% relative humidity for forty-eight hours and cleaning said slides by dipping 120 times into a washing bath containing 2.4 g/l of test detergent which is maintained at a temperature of 47° C. After washing, the slides are dried in ambient air for two hours. The unremoved grease solidifies on the slides and the percent degreasing (DG) is calculated according to the following formula:

$$\% DG = \frac{P_2 - P_3}{P_2 - P_1} \times 100$$

$P_1$ = Weight of precleaned slide
$P_2$ = Weight of soiled slide
$P_3$ = Weight of washed and dried slide.

TABLE I

| Formulae (weight percent) | | | | | Baumgartner Test % Degreasing | |
|---|---|---|---|---|---|---|
| P.S.[1] | ALES[2] | N.I.[3] | EDAC[4] | Mole Ratio[5] | 0 PPM | 300 PPM |
| 20 | 2.5 | 2.5 | 0 | — | 2 | N.E (x) |
| 20 | 2.5 | 2.5 | 5 | 1.9:1 | 18 | N.E |
| 32 | 4 | 4 | 0 | — | 2 | 60 |
| 32 | 4 | 4 | 5 | 3.0:1 | 51 | 62 |

(x): N.E. = Not evaluated

It has been found tht the organic diamine diacid salt is effective in increasing foaming when added to clear, liquid detergent formulae based on paraffin sulfonate as the principal detergent which contain 40%, 25% and 15% weight concentrations of detergent (anionic plus nonionic), i.e., active ingredient (AI), solubilized in an aqueous medium. The following Table II summarizes the results in water at 0 and 300 ppm ($CaCO_3$) hardness using the Automatic Miniplates Test procedure at a concentration of 1.25 g/l of detergent composition.

TABLE II

| Formulae (weight percent) | | | | | | | No. of Miniplates | |
|---|---|---|---|---|---|---|---|---|
| P.S.[1] | ALES[2] | N.I.[3] | Urea | Ethanol | EDAC[4] | Mole Ratio[5] | 0 PPM | 300 PPM |
| 32 | 4 | 4 | 2 | 3.1 | 0 | — | No foam produced | 55 |
| 20 | 2.5 | 2.5 | 2 | 3.1 | 0 | — | | 34 |
| 10 | 5 | 0 | 2 | 0 | 0 | — | | 23 |
| 32 | 4 | 4 | 2 | 3.1 | 2 | 7.4:1 | 31 | 56 |
| 32 | 4 | 4 | 2 | 3.1 | 5 | 3:1 | 49 | 55 |
| 20 | 2.5 | 2.5 | 2.5 | 3.1 | 2 | 4.6:1 | 24 | 35 |
| 20 | 2.5 | 2.5 | 3 | 3.1 | 5 | 1.9:1 | 31 | 33 |
| 10 | 5 | 0 | 2 | 0 | 2 | 2.9:1 | 13 | 22 |
| 10 | 0 | 2 | 2 | 0 | 5 | 0.9:1 | 14 | 20 |

[1]Sodium $C_{14-17}$ paraffin sulfonate
[2]Ammonium $C_{12}$–$C_{15}$ alkyl ether triethenoxy sulfate
[3]Condensate of nonyl phenol with 9 moles of ethylene oxide (EO)
[4]Ethylene diamine dihydrochloride
[5]Mole ratio of mono-anionic sulfonated detergent to organic amine diacid salt The improved degreasing properties of the foregoing 40% active ingredient formula containing varying concentrations of EDAC in water having a hardness of from 0 to 100 ppm of calcium carbonate is shown in Table III below:

TABLE III

| Water hardness (ppm) | Baumgartner Test % Degreasing | | | |
|---|---|---|---|---|
| | 0% EDAC | 2% EDAC* | 3.5% EDAC** | 5% EDAC*** |
| 0 | 2 | 2 | 49 | 63 |

TABLE III-continued

| Water hardness (ppm) | Baumgartner Test % Degreasing | | | |
|---|---|---|---|---|
| | 0% EDAC | 2% EDAC* | 3.5% EDAC** | 5% EDAC*** |
| 20 | 1 | 1 | 72 | 66 |
| 40 | 1 | 69 | 68 | 62 |
| 70 | 21 | 83 | 69 | 68 |
| 100 | 82 | 71 | 66 | 58 |

*mole ratio of mono-anionic surfactant to ethylene diamine dihydrochloride salt of 7.4:1.
**mole ratio of mono-anionic surfactant to ethylene diamine dihydrochloride salt of 4.3:1
***mole ratio of mono-anionic surfactant to ethylene diamine dihydrochloride salt of 3:1

Tables II and III clearly show that the inclusion of a sufficient amount of ethylene diamine dihydrochloride salt in compositions containing a mixture of paraffin sulfonate and alkyl ether triethenoxy sulfate detergent markedly improves degreasing properties in water having a hardness of 0 to 70 ppm. More specifically, Table II clearly shows the sharp increase in degreasing properties in 0 ppm water (deionized) upon addition of 5% by weight of EDAC to the 40% active ingredient level formula, i.e., from 2% to 51%. Further, it appears that in order to provide the same degreasing ability of the 40% A.I. content formula in 0 ppm water as in 300 ppm water hardness, more than 5% EDAC is required. The use of 6% EDAC in high A.I. level IDLD formula affords about the same degreasing capacity in deionized water as in 300 ppm water, but increasing the EDAC content beyond about 7.5% (2:1 anionic to amine diacid mole ratio) affords no additional benefit to this formulation. Table III shows that the addition of EDAC to the 40% active ingredient formula results in improved degreasing properties over a water hardness range of 0–70 ppm, with greater concentrations of EDAC required for water of 0 ppm hardness. Also, the benefit of EDAC seems to disappear in water of 100 ppm hardness. However, based upon the 40% active ingredient formula in 0 ppm water, the inclusion of 5% EDAC therein permits a reduction in the active ingredient proportion from 40% to 35%–28% paraffin sulfonate—3.5%$C_{12}C_{15}$ alkyl triethenoxy ether sulfate—3.5% nonylphenol ethoxylate (9Et0)—while maintaining the same degreasing ability as the 40% A.I. formula in hard water.

The LDD formulations of this invention comprise a water soluble, anionic, detergent or mixture thereof having in its molecular structure a higher alkyl, alkylaryl, alkenyl or acyl group containing from 8 to 22 carbon atoms and an anionic sulfonate or sulfate group as the principal detergent component in amounts of about 5 to 50% by weight. Such detergents are employed in the form of water-soluble salts and the salt-forming cation usually is selected from the group consisting of sodium, potassium, ammonium, and mono-, di- or tri- $C_2$–$C_{18}$ alkanolammonium, with the sodium and ammonium cations being preferred.

Suitable anionic detergents include the following.

1. The $C_8$–$C_{18}$ alkyl sulfates which are usually obtained by sulfating $C_8$–$C_{18}$ alkanols obtained by reducing the glycerides of tallow or coconut oil. Preferred alkyl sulfates contain 10 to 16 carbons in the alkyl group.

2. The $C_9$–$C_{15}$ alkylbenzene sulfonates wherein the alkyl group is either a straight chain or a branched chain, with the straight chain being preferred for its improved biodegradability. A specific example is sodium dodecylbenzene sulfonate.

3. The $C_8$–$C_{22}$ olefin sulfonates which may be obtained by sulfonating the appropriate olefin. Preferred olefin sulfonates contain from 12 to 22 carbon atoms in the alkenyl group obtained by sulfonating an $\alpha$-olefin. A specific example is $C_{14-17}$ olefin sulfonate.

4. The $C_8$–$C_{18}$ alkyl ether ethylenoxy sulfates of the formula $R(OC_2H_4)_n$ $OSO_3M$ wherein n is 1–12 and preferably 1–6, R is an alkyl group containing 8–18 carbon atoms and preferably 10–16 carbons; and M is a cation, preferably sodium or ammonium, obtained by sulfonating and neturalizing the reaction product of one mole of alkanol with n moles of ethylene oxide. The most preferred alkyl ether ethylenoxy sulfates contain 12 to 15 carbon atoms in the alkyl group and contain 1–6 ethylene oxide groups per mole of alkanol, such as ammonium lauryl triethenoxy ether sulfate.

5. The $C_{10}$–$C_{20}$ paraffin sulfonates obtained, for example, by reacting an $\alpha$-olefin with bisulfite. Preferred alkane sulfonates contain 14 to 17 carbon atoms in the alkyl group, such as sodium $C_{14-17}$ paraffin sulfonate.

6. The $C_6$–$C_{12}$ phenyl ether polyethylenoxy sulfates containing from 2 to 6 moles of ethylene oxide in the molecule may be used, too. These detergents can be prepared by reacting an alkyl phenol with 2 to 6 moles of ethylene oxide and sulfating and neutralizing the resultant ethoxylated alkylphenol. Preferred detergents in this group have 8 to 12 carbons in the alkyl group and contain about 4 ethylene oxide groups in the molecule such as ammonium nonylphenyl tetraethenoxy ether sulfate.

7. The $C_8$–$C_{12}$ alkyl sulfonacetates corresponding to the formula $ROOCH_2SO_3M$ wherein R is a $C_8$–$C_{18}$ alkyl which may be prepared by esterifying an alkanol with chloroacetic acid or chloracetylchloride and then reacting the chloroester with a sodium or potassium bisulfite. Preferred sulfoacetates contain 12 to 16 carbon atoms in the alkyl group.

8. The N-mono-$C_8$–$C_{22}$ alkyl or alkenyl (includes alkyl or alkenyl groups interrupted by an ether or amido group) sulfosuccinates prepared by reacting, for example, either one mole of $C_8$–$C_{18}$ alkanol or a $C_8$–$C_{18}$ alkoxy $C_2$–$C_3$ alkanol or a $C_8$–$C_{18}$ alkanamido $C_2$–$C_3$ alkanol with maleic acid and reacting the resultant product with an alkali metal bisulfite to form an N-mono-$C_8$–$C_{22}$ alkyl sulfosuccinate. It should be recognized that the alkyl group of product made from the N-acyl alkanolamine will contain an amido intermediate linkage. Similarly, the alkyl group may be interrupted by an ether linkage or ester linkage if an alkyl ether ethanol or an alkyl ether of ethylene glycol is reacted with maleic acid. Preferred sulfosuccinates are disodium N-mono-$C_8$–$C_{18}$ acylisopropanolamidnosulfosuccinate, disodium lauryl sulfosuccinate and N-monooleylisopropanolamidosulfosuccinate.

9. The N—$C_8$–$C_{18}$ acyl taurines may be produced by neutralizing the reaction product of a $C_8$–$C_{18}$ alkanoic acid with aminoethylsulfonic acid. Again, preferred taurates contain 12 to 14 carbon atoms in an acyl group obtained by reduction of coconut oil.

10. The O–$C_8$–$C_{18}$ acyl isethionates may be produced by neutralizing the reaction product of a $C_8$–$C_{18}$ alkanoic acid with 2-hydroxyethanesulfonic acid. Similar to the taurines, the preferred isethionates contain 12 to 14 carbon atoms in an acyl group obtained by reduction of coconut oil.

Nonionic surfactants in minor amounts of up to about 10%, preferably 5%, by weight may optionally be included in the anionic surfactant based liquid compositions of this invention. Suitable nonionic surfactants include the ethoxylated fatty alcohols having 8 to 18 carbon atoms and 2 to 30 moles of ethylene oxide per mole alcohol, ethoxylated alkylphenols having 6 to 12 carbons in the alkyl group and 5 to 200 moles of ethylene oxide per mole; ethoxylated fatty alkanolamides having the structure $R_1CONR_2R_3(EtO)_x$ wherein $R_1GO$ is an acyl group containing 6 to 18 carbon atoms, $R_2$ is an H, $CH_3$ or $CH_2CH_2OH$ group, $R_3$ is a $CH_3$, $CH_2CH_2OH$ or a $CH_2CHOHCH_3$ group and x is an integer from 0 to 20; ethoxylated lanolin derivatives and ethoxylated sorbitans, including fatty acid esters of sorbitol having 10 to 18 carbon atoms in the fatty acid group and 10 to 100 moles of ethylene oxide per mole of sorbitan. Other suitable foam stabilizing nonionic detergents are the trialkyl polar amine oxides having the formula $R_1R_2R_3N{\rightarrow}O$ wherein $R_1$ is a $C_8$–$C_{18}$ alkyl, alkenyl or hydroxy alkyl group and $R_2$ and $R_3$ are each methyl, ethyl, propyl, ethanol or propanol or $R_2$ and $R_3$ are joined together with the nitrogen atom to form a morpholino group. Preferred foam stabilizers include lauric-myristic monoethanolomide, lauric-myristic diethanolamide and lauryl dimethyl amine oxide.

The balance of the light duty detergent composition in solid form usually will be a water-soluble inorganic sulfate, e.g., sodium sulfate. On the other hand, in the liquid form, the balance will be an aqueous medium consisting of water and up to 20% by weight of solubilizing agents, e.g., $C_2$–$C_3$ alcohols, $C_1$–$C_3$ alkyl substituted benzene sulfonate hydrotropes, etc.

In addition to the previously mentioned anionic and nonionic surfactants, one may also employ normal and conventional additives provided that they do not adversely affect the properties of the detergent composition. Typical additives include various coloring agents and perfumes; bactericides; preservatives such as formaldehyde or hydrogen peroxide; pearlescing agents and opacifiers; pH modifiers to maintain a pH of about 6-8; aromatic hydrotropes such as ammonium, sodium or potassium xylene sulfonate and sodium cumene sulfonate; and a viscosity and/or clear point modifier such as ethanol, propanol isopropanol, propylene glycol and mixtures thereof. The proportion of such additives, in total, will normally not exceed 20% by weight of the liquid composition. The percentage of each individual component usually will be a maximum of 10% by weight and preferably less than 5% by weight.

The present LDD my be prepared in either solid or liquid form. Typically, the solid form is particulate and is prepared by spray drying or dryn drying an aqueous mixture of the surfactant, diamine diacid salt and sodium sulfate to yield a product in the form of spray dried particles or flakes. The more prevalent form is the liquid form and such dishwashing liquids are readily prepared by simple mixing methods from readily available components. In one preferred method of manufacture, the diacid salt of the low molecular weight alkylene diamine foaming agent, such as ethylene diamine dihydrochloride, in the form of a solid or an aqueous solution in admixed with an aqueous solution of the anionic surfactant which optionally may have been premixed with an aqueous solution of a nonionic surfactant and optional solubilizers such as an aromatic hydrotropic agent, e.g., sodium xylene sulfonate, a lower alcohol, e.g., ethanol, and/or urea to assist in solubilizing said surfactants and then adding with agitation the rest of the water to form the liquid detergent composition. Alternatively, the foaming agent may be formed in situ by adding the alkylene diamine to an aqueous solution of surfactants containing an acid such as hydrochloric, sulphuric or nitric acid in a sufficient amount to react with the alkylene diamine to form the diacid salt thereof.

The viscosities of the light duty liquid detergent (LDLD) are adjustable by changing the total percentage of active ingredients and by modifying the percentage of the optional urea, lower alcohol and hydrotrope ingredients. In all such cases, the product will be pourable from a relatively narrow mouth bottle (1.5 cm diameter) or opening, and the viscosity of the detergent will not be so low as to be like water. The viscosity of the detergent should be at least 100 cps at room temperature, and up to about 1,000 centipoises. Its viscosity usually will approximate those of commercially acceptable detergents now on the market. This detergent is stable on storage, without color changes or settling out of any insoluble materials. The pH of this LDLD is neutral, about 6 to 8.

These products have unexpectedly improved foaming and degreasing properties in soft water (0 to 70 ppm) which were heretofore unobtainable with anionic sulfonated detergent based LDD compositions. In addition, the presence of the organic diamine diacid salts reduces the active ingredient content required to effect aforesaid superior foaming and degreasing properties, without impairing the stability of a final product.

The following examples are merely illustrative of the invention and are not to be construed as limiting thereof.

EXAMPLES 1-5

| Ingredient | % by weight | | | | |
|---|---|---|---|---|---|
| | Ex. 1 | Ex. 2 | Ex. 3 | Ex. 4 | Ex. 5 |
| Sodium $C_{14-17}$ paraffin sulfonate | 32 | 20 | 10 | 20 | 24 |
| Ammonium $C_{12}$–$C_{15}$ alkyl ether triethenoxy sulfate | 4 | 2.5 | 5 | 2.5 | 3 |
| $C_9$–$C_{11}$ alcohol 8 EO (nonionic) | 4 | 2.5 | — | 2.5 | 3 |
| Alkylene diammonium dihydrochloride[5] (EDAC) or (PDAC) | 5 | 5 | 5 | 3 | 2 |
| Urea | 10 | 10 | 10 | 10 | 8 |
| Ethanol | 5 | 3.6 | 3 | — | — |
| Minor ingredients (EDTA, Colour, Perfume) | ±1 | ±1 | ±1 | ±1 | ±1 |
| Water | balance | balance | balance | balance | balance |
| Mole ratio - Anionic detergent: 1 EDAC | 3.0:1 | 1.9:1 | 1.2:1 | 3.1:1 | 5.6:1 |
| Mole ratio - Anionic detergent: 1 PDAC | 3.3:1 | 2.1:1 | 1.3:1 | 3.4:1 | 6.2:1 |

-continued

[5]ethylene diamine dihydrochloride or propylene diamine dihydrochloride

The foregoing compositions are clear liquid detergents having a pH in the range of 6–8 and viscosities in the range of 100 to 250 centipoises at 25° C. as measured with a Brookfield Viscometer Model LVT, using a No. 2 spindle rotating at a speed of 30 rpm. Also, Examples 1–3 represent preferred compositions for 40%, 25% and 15% AI concentrations. In each of the examples 1–3, 5% EDAC improves the foam stability in water at 0 ppm hardness without significantly affecting the performance in hard water as shown in Table I of the specification. Also, shown in this Table is the improvement in foam stability in 0 ppm water with the use of as little as 2% EDAC without affecting hard water performance. Examples 6–8 set forth other satisfactory LDLD compositions.

EXAMPLES 6–8

| Ingredients | % by weight | | |
|---|---|---|---|
| | Ex. 6 | Ex. 7 | Ex. 8 |
| Sodium $C_{14-17}$ paraffin sulfonate | 20 | 20 | 20 |
| Ammonium $C_{12}$–$C_{15}$ alkyl ether triethenoxy sulfate | 2.5 | 2.5 | 2.5 |
| Nonionic ($C_9$–$C_{11}$)alcohol 8 EO | 2.5 | 2.5 | 2.5 |
| Di-ethoxylated ethylene diamine | 2.23 | — | — |
| Tri-ethoxylated ethylene diamine | — | 2.89 | — |
| Tetraethoxylated ethylene diamine | — | — | 3.55 |
| Hydrochloric acid (37%) | 2.95 | 2.95 | 2.95 |
| Minor ingredients | ±1 | ±1 | ±1 |
| Water | balance | balance | balance |
| mole ratio - anionic detergent to diamine diacid | 4.7:1 | 4.7:1 | 4.7:1 |

In the foregoing examples the diacid salts of the alkylene diamines are made in situ by the reaction between the diamine component and the hydrochloric acid.

A clear, light duty, liquid detergent composition containing alkylbenzene sulfonate detergent follows:

EXAMPLE 9

| Ingredients | % by weight |
|---|---|
| Sodium dodecylbenzene sulfonate | 15 |
| Alkylene diammonium dihydrochloride[5] | 2 |
| Ethanol | 15 |
| Urea | 10 |
| Sodium xylene sulfonate | 5 |
| Minor ingredients (perfume, colour, EDTA) | ±1 |
| Water | balance |
| Mole ratio-amionic detergent: EDAC | 2.8:1 |
| Mole ratio-anionic detergent: PDAC | 3.1:1 |

A clear LDLD composition containing piperazine diamine dihydrochloride follows:

EXAMPLE 10

| Ingredient: | % by weight |
|---|---|
| P.S.[1] | 20.00 |
| ALES[2] | 2.50 |

-continued

| Ingredient: | % by weight |
|---|---|
| N.I.[3] | 2.50 |
| Ethanol | 2.50 |
| Urea | 5.00 |
| Piperazine diamine dihydrochloride | 3.00 |
| Formalin | 0.20 |
| Color | 0.825 |
| Perfume | 0.15 |
| Water | balance |

The foaming properties of the compositions described in Examples 6–10 in 0 ppm water is set forth in Table IV below:

TABLE IV

| Composition | Performance No. of MP @ 0 ppm |
|---|---|
| Example 6 | 15 |
| Example 7 | 14 |
| Example 8 | 10 |
| Example 9 | 12 |
| Example 10 | 23 |

The acid salt of piperazine is equivalent to EDAC in foam enhancing properties in 0 ppm water.

Satisfactory clear LDLD's containing the dinitric acid and dihydrosulfuric acid salts of ethylene diamine follow:

EXAMPLES 11 and 12

| Ingredients | by weight 11 | 12 |
|---|---|---|
| P.S.[1] | 20.00 | 20.00 |
| ALES[2] | 2.50 | 2.50 |
| N.I.[3] | 2.50 | 2.50 |
| Ethanol | 2.50 | 2.50 |
| Urea | 5.00 | 5.00 |
| Dinitric acid salt of ethylene diamine* | 3.00 | — |
| Dihydrosulfuric acid salt of ethylene diamine** | — | 3.00 |
| Color solution (1% color) | 0.825 | 0.825 |
| Perfume | 0.15 | 0.15 |
| Formalin | 0.20 | 0.20 |
| Water | balance to 100% | balance to 100% |

*Mole ratio of mono-anionic detergent to said salt is 4.3:1
**Mole ratio of mono-anionic detergent to said salt is 6:1

In the Automatic Miniplate Dishwashing Test, the composition of Example 11 washed 24 miniplates in 0 ppm water and the composition of Example 12 washed 25 plates in 0 ppm water. These results are essentially identical to those of substantially the same formula, but containing 3% by weight of ethylene - diamine dihydrochloride, which washed 25 plates at 0 ppm.

The dinitric and dihydrosulfuric acid salts of ethylene diamine are equivalent to the dihydrochloride salts because only the cationic part of the salt appears to be essential to increase the performance of anionic surfactants in water of low hardness.

Other suitable clear LDLD's are shown in the following examples:

EXAMPLES 13–16

| Ingredients | by weight 13 | 14 | 15 | 16 |
|---|---|---|---|---|
| LAS Na[7] | 20 | — | — | — |
| ALES[2] | 2.5 | 22.5 | 2.5 | 2.5 |
| OS Na[8] | — | — | 20 | — |
| NPES 4 EO[9] | — | — | — | 20 |
| N.I.[3] | 2.5 | 2.5 | 2.5 | 2.5 |
| SXS[10] | 3 | — | 3 | — |
| Urea | 10 | 10 | 10 | 10 |
| Ethanol | 2 | — | — | — |
| EDAC | 3 | 3 | 3 | 3 |
| Formulin | 0.2 | 0.2 | 0.2 | 0.2 |
| Color | 0.825 | 0.825 | 0.85 | 0.825 |
| Water | Balance to 100% | | | |
| Mole ratio of anionic detergent to EDAC | 3.1:1 | 2.5:1 | 3.1:1 | 2:1:1 |

[7]sodium dodecylbenzene sulfonate
[8]sodium $C_{14-17}$ olefin sulfonate
[9]ammonium nonylphenol tetraethenoxy ether sulfate
[10]sodium xylene sulfate

[9]ammonium nonylphenol tetraethenoxy ether sulfate
[10]sodium xylene sulfate

When the foregoing compositions are evaluated in the Automatic Miniplates Dishwashing Test, the following results obtain:

| Example | Number of MP 0 PPM | 25 PPM |
|---|---|---|
| 13 | 21 | 20 |
| 14 | 18 | 16 |
| 15 | 20 | 21 |
| 16 | 21 | 23 |

The same products, but without EDAC, showed the following results:

| | | |
|---|---|---|
| 13' | 0 | 19 |
| 14' | 0 | 13 |
| 15' | 0 | 15 |
| 16' | 0 | 15 |

These examples illustrate the effectiveness of the ethylene diamine dihydrochloride salts with other anionic surfactants in increasing foaming performance in soft water (25 ppm), and deionized water (0 ppm).

Variations in the above formulations may be made. For example, other anionic sulfonates and sulfates and combinations thereof, and in different amounts, may be substituted for the particular anionic surfactants in aforesaid examples. Similarly, other nonionic surfactants may be substituted for the specific nonionics used in the examples. Likewise, the amount of the diacid salt of the organic diamine foaming and degreasing agent generally will be in the range of 1% to 10%, preferably, 2% to 8%, in order to improve detergency performance of the anionic surfactants in soft water. (These ranges generally correspond to mono-anionic sulfonate/sulfate detergent to organic diamine diacid salt mole ratios in the range of 0.8:1 to 9:1, preferably 1:1 to 6:1, and optimally about 2:1.) The term "anionic sulfonated detergents" as used herein refers to anionic detergents containing either an —$OSO_3$— or an —$SO_3$— solubilizing group or a mixture of detergents containing such groups.

This invention is applicable to light duty detergent compositions which are intended primarily for fine laundering and for dishwashing. Such compositions consist essentially of an anionic organic detergent as the principal ingredient and may contain minor proportions of foam stabilizers and/or inorganic or organic detergent builder salts. These compositions are different than the heavy duty detergent products which are used primarily for machine laundering of textiles wherein a mixture of organic detergent and detergent builder salts is typical, with said builder salts usually being the principal component. More particularly, light duty detergent compositions usually either contain no recognized detergent builder salt or may contain 0.2–2% by weight of a builder salt as a sequestering agent. Since sodium sulfate often is employed in the solid light duty detergent compositions, it should be understood that this ingredient is not classed a detergent builder salt.

It is understood that the foregoing detailed description is given merely by way of illustration and that variations may be made therein without departing from the spirit of the invention. The "Abstract" given above is merely for the convenience of technical searchers and is not to be given any weight with respect to the scope of the invention.

We claim:

1. In a light duty detergent composition containing 5% to 50% by weight of a water-soluble, anionic, organic sulfonate or sulfate detergent, the improvement comprising the inclusion therein of an effective amount of a low molecular weight organic diamine diacid salt selected from the range wherein the mole ratio of mono-anionic detergent to said diacid salt is from 0.8:1 to 9:1 and sufficient to improve salt water foaming and degreasing properties, said acid being selected from the group consisting of hydrochloric, nitric and sulfuric acids.

2. The improvement in accordance with claim 1 wherein said organic diamine diacid salt is selected from the group consisting diacid salts of piperazine diamine, phenylene diamine, xylene diamine, $C_2$–$C_{11}$ alkylene diamine and condensates of $C_2$–$C_{11}$ alkylene diamine with one to four moles of ethylene oxide.

3. The improvement in accordance with claim 2 wherein said organic diamine diacid salt is the diacid salt of $C_2$–$C_{11}$ alkylene diamine.

4. The improvement in accordance with claim 2 wherein said organic diamine diacid salt is the diacid salt of $C_2$–$C_4$ alkylene diamine.

5. The improvement in accordance with claim 2 wherein from 1% to 8% by weight of a water-soluble nonionic detergent is present in addition.

6. The improvement in accordance with claim 4, wherein said organic diamine diacid salt is ethylene diamine dihydrochloride.

7. The improvement in accordance with claim 4, wherein said organic diamine diacid salt is propylene diamine dihydrochloride.

8. The improvement in accordance with claim 2, wherein said organic diamine diacid salt is piperazine dihydrochloride.

9. The improvement in accordance with claim 2, wherein said organic diamine diacid salt is a diacid salt of a mono-, di-, tri-, or tetra-ethoxylate of ethylene diamine.

10. The improvement in accordance with claim 2, wherein said organic diamine diacid salt is a diacid salt of a mono-, di-, tri-, or tetra-ethoxylate of propylene diamine.

11. The improvement in accordance with claim 2 wherein said composition contains 10% to 40% by weight of said anionic detergent solubilized in an aqueous medium.

* * * * *

UNITED STATES PATENT AND TRADEMARK OFFICE

CERTIFICATE OF CORRECTION

PATENT NO. : 4,556,509

DATED : December 3, 1985

INVENTOR(S) : Yvon Demangeon and Alain Jacques

It is certified that error appears in the above-identified patent and that said Letters Patent are hereby corrected as shown below:

Claim 1, line 8, delete "salt" and insert -- soft --.

Signed and Sealed this

*Twenty-fifth* Day of *March 1986*

[SEAL]

*Attest:*

DONALD J. QUIGG

*Attesting Officer*

*Commissioner of Patents and Trademarks*